US008808153B2

(12) United States Patent
Yanchev et al.

(10) Patent No.: US 8,808,153 B2
(45) Date of Patent: Aug. 19, 2014

(54) APPARATUS FOR ASSEMBLY OF MULTI-SEGMENT ROD-LIKE ARTICLES

(75) Inventors: Dimitar Yanchev, Plovdiv (BG); Plamen Iliev, Plovdiv (BG); Yanko Yanchev, Dunn Loring, VA (US)

(73) Assignee: Aiger Group AG, Zug (CH)

( * ) Notice: Subject to any disclaimer, the term of this patent is extended or adjusted under 35 U.S.C. 154(b) by 1024 days.

(21) Appl. No.: 12/502,477

(22) Filed: Jul. 14, 2009

(65) Prior Publication Data

US 2011/0011412 A1 Jan. 20, 2011

(51) Int. Cl.
*B31C 99/00* (2009.01)

(52) U.S. Cl.
USPC ..... 493/4; 493/39

(58) Field of Classification Search
USPC ..... 493/4, 9, 17, 22, 39, 44, 45, 46, 48, 941
See application file for complete search history.

(56) References Cited

U.S. PATENT DOCUMENTS

| | | | | |
|---|---|---|---|---|
| 2,649,761 | A * | 8/1953 | Edwards | 131/94 |
| 3,131,612 | A | 5/1964 | Rowlands | |
| 3,297,038 | A | 1/1967 | Homburger | |
| 3,308,600 | A | 3/1967 | Erdmann et al. | |
| 3,339,557 | A | 9/1967 | Karalus | |
| 3,339,558 | A | 9/1967 | Waterbury | |
| 3,366,121 | A | 1/1968 | Carty | |
| 3,390,686 | A | 7/1968 | Irby, Jr. et al. | |
| 3,420,242 | A | 1/1969 | Boukair | |
| 3,424,172 | A | 1/1969 | Neurath et al. | |
| 3,428,049 | A | 2/1969 | Leake et al. | |
| 3,508,558 | A | 4/1970 | Seyburn | |
| 3,513,859 | A | 5/1970 | Carty | |
| 3,547,130 | A | 12/1970 | Harlow et al. | |
| 3,550,750 | A | 12/1970 | Jackson | |
| 3,575,180 | A | 4/1971 | Carty | |
| 3,596,665 | A | 8/1971 | Lindgard | |
| 3,602,231 | A | 8/1971 | Dock | |
| 3,625,228 | A | 12/1971 | Dock | |
| 3,635,226 | A | 1/1972 | Horsewell et al. | |
| 3,669,128 | A | 6/1972 | Cohen | |
| 3,685,521 | A | 8/1972 | Dock | |
| 3,797,644 | A | 3/1974 | Shaw | |
| 3,818,223 | A | 6/1974 | Gibson et al. | |
| 3,915,176 | A | 10/1975 | Heitmann et al. | |

(Continued)

FOREIGN PATENT DOCUMENTS

| | | | |
|---|---|---|---|
| EP | 1702524 | A1 | 9/2006 |
| EP | 1767107 | A1 | 3/2007 |

(Continued)

OTHER PUBLICATIONS

International Search Report dated Feb. 9, 2011 in corresponding International Patent Application No. PCT/US2010/041892, 5 pages.

*Primary Examiner* — Sameh H. Tawfik
(74) *Attorney, Agent, or Firm* — Maier & Maier, PLLC

(57) ABSTRACT

An apparatus for assembly of multi-segment rod-like objects, such as, for example, components of a composite cigarette filter, is disclosed. The apparatus may include an intercalating unit and an assembly unit, linked by a transfer unit. Intercalating unit may include at least one rod supply unit and a conveyor. In one embodiment, intercalating unit may include a plurality of independent rod supply units. Each rod supply unit may include a hopper and a rod delivery mechanism comprising a rotary drum, a cutting device, a transfer wheel and a delivery wheel.

10 Claims, 6 Drawing Sheets

(56) References Cited

U.S. PATENT DOCUMENTS

| | | | | |
|---|---|---|---|---|
| 3,916,914 | A | 11/1975 | Brooks et al. | |
| 3,957,152 | A | 5/1976 | Heitmann | |
| 3,972,335 | A | 8/1976 | Tiggelbeck et al. | |
| 3,991,773 | A | 11/1976 | Walker | |
| 4,003,387 | A | 1/1977 | Goldstein | |
| 4,033,387 | A | 7/1977 | Nijs et al. | |
| 4,040,430 | A * | 8/1977 | Molins | 131/94 |
| 4,043,454 | A | 8/1977 | Reuland | |
| 4,046,153 | A | 9/1977 | Kaye | |
| 4,082,098 | A | 4/1978 | Owens, Jr. | |
| 4,126,141 | A | 11/1978 | Grossman | |
| 4,185,941 | A | 1/1980 | Molins et al. | |
| 4,238,993 | A | 12/1980 | Brand et al. | |
| 4,262,680 | A * | 4/1981 | Hinzmann | 131/94 |
| 4,280,187 | A | 7/1981 | Reuland et al. | |
| 4,281,670 | A | 8/1981 | Heitmann et al. | |
| 4,281,671 | A | 8/1981 | Bynre et al. | |
| 4,284,088 | A | 8/1981 | Brand et al. | |
| 4,287,979 | A | 9/1981 | Molins et al. | |
| 4,291,713 | A | 9/1981 | Frank | |
| 4,301,816 | A | 11/1981 | Wahle et al. | |
| 4,474,190 | A | 10/1984 | Brand | |
| 4,574,816 | A | 3/1986 | Rudszinat | |
| 4,667,687 | A | 5/1987 | Hinchcliffe et al. | |
| 4,677,995 | A | 7/1987 | Kallianos et al. | |
| 4,714,083 | A | 12/1987 | Luke | |
| 4,723,559 | A | 2/1988 | Labbe | |
| 4,729,391 | A | 3/1988 | Woods et al. | |
| 4,736,754 | A | 4/1988 | Heitmann et al. | |
| 4,781,203 | A | 11/1988 | La Hue | |
| 4,807,809 | A | 2/1989 | Pryor et al. | |
| 4,811,745 | A | 3/1989 | Cohen et al. | |
| 4,844,100 | A | 7/1989 | Holznagel | |
| 4,848,375 | A | 7/1989 | Patron et al. | |
| 4,850,301 | A | 7/1989 | Greene, Jr. et al. | |
| 4,862,905 | A | 9/1989 | Green, Jr. et al. | |
| 4,865,056 | A | 9/1989 | Tamaoki et al. | |
| 4,878,506 | A | 11/1989 | Pinck et al. | |
| 4,889,144 | A | 12/1989 | Tateno et al. | |
| 4,925,602 | A | 5/1990 | Hill et al. | |
| 4,941,486 | A | 7/1990 | Dube et al. | |
| 5,012,823 | A | 5/1991 | Keritsis et al. | |
| 5,012,829 | A | 5/1991 | Thesing et al. | |
| 5,025,814 | A | 6/1991 | Raker | |
| 5,060,664 | A | 10/1991 | Siems et al. | |
| 5,060,665 | A | 10/1991 | Heitmann | |
| 5,156,169 | A | 10/1992 | Holmes et al. | |
| 5,191,906 | A | 3/1993 | Myracle et al. | |
| 5,220,930 | A | 6/1993 | Gentry | |
| 5,223,185 | A | 6/1993 | Takei et al. | |
| 5,225,277 | A | 7/1993 | Takegawa et al. | |
| 5,271,419 | A | 12/1993 | Arzonico et al. | |
| 5,331,981 | A | 7/1994 | Tamaoki et al. | |
| 5,387,093 | A | 2/1995 | Takei | |
| 5,387,285 | A | 2/1995 | Rivers | |
| 5,476,108 | A | 12/1995 | Dominguez et al. | |
| 5,724,997 | A | 3/1998 | Smith et al. | |
| 5,931,278 | A * | 8/1999 | Watanabe | 198/438 |
| 6,229,115 | B1 | 5/2001 | Voss et al. | |
| 6,360,751 | B1 | 3/2002 | Fagg et al. | |
| 6,384,359 | B1 | 5/2002 | Belcastro et al. | |
| 6,385,333 | B1 | 5/2002 | Puckett et al. | |
| 6,647,870 | B2 | 11/2003 | Kohno | |
| 6,779,530 | B2 | 8/2004 | Kraker | |
| 6,848,449 | B2 | 2/2005 | Kitao et al. | |
| 6,904,917 | B2 | 6/2005 | Kitao et al. | |
| 7,074,170 | B2 | 7/2006 | Lanier, Jr. et al. | |
| 7,115,085 | B2 | 10/2006 | Deal | |
| 8,186,359 | B2 | 5/2012 | Ademe et al. | |
| 2002/0020420 | A1 | 2/2002 | Xue et al. | |
| 2002/0166563 | A1 | 11/2002 | Jupe et al. | |
| 2003/0098033 | A1 | 5/2003 | Macadam et al. | |
| 2003/0136419 | A1 | 7/2003 | Muller | |
| 2003/0145866 | A1 | 8/2003 | Hartmann | |
| 2003/0178036 | A1 | 9/2003 | Demmer et al. | |
| 2004/0129281 | A1 | 7/2004 | Hancock et al. | |
| 2004/0261807 | A1 | 12/2004 | Dube et al. | |
| 2005/0016556 | A1 | 1/2005 | Ashcraft et al. | |
| 2005/0039764 | A1 | 2/2005 | Barnes et al. | |
| 2005/0054501 | A1 | 3/2005 | Schroder | |
| 2005/0066986 | A1 | 3/2005 | Nestor et al. | |
| 2005/0070409 | A1 | 3/2005 | Deal | |
| 2005/0076929 | A1 | 4/2005 | Fitzgerald et al. | |
| 2005/0103355 | A1 | 5/2005 | Holmes | |
| 2005/0133051 | A1 | 6/2005 | Luan et al. | |
| 2005/0194014 | A1 | 9/2005 | Read, Jr. | |
| 2005/0282693 | A1 | 12/2005 | Garthaffner et al. | |
| 2006/0112964 | A1 | 6/2006 | Jupe et al. | |
| 2006/0144412 | A1 | 7/2006 | Mishra et al. | |
| 2006/0174901 | A1 | 8/2006 | Karles et al. | |
| 2006/0207616 | A1 | 9/2006 | Hapke et al. | |
| 2006/0272655 | A1 | 12/2006 | Thomas et al. | |
| 2006/0272663 | A1 | 12/2006 | Dube et al. | |
| 2006/0293157 | A1 | 12/2006 | Deal | |
| 2007/0012327 | A1 | 1/2007 | Karles et al. | |
| 2007/0068540 | A1 | 3/2007 | Thomas et al. | |
| 2007/0095357 | A1 | 5/2007 | Besso et al. | |
| 2007/0117700 | A1 | 5/2007 | Kushihashi et al. | |
| 2007/0246055 | A1 | 10/2007 | Oglesby | |
| 2008/0029118 | A1 | 2/2008 | Nelson et al. | |
| 2009/0090372 | A1 | 4/2009 | Thomas et al. | |
| 2009/0120449 | A1 | 5/2009 | Tindall | |
| 2009/0145449 | A1 | 6/2009 | Cieslikowski et al. | |
| 2010/0099543 | A1 | 4/2010 | Deal | |

FOREIGN PATENT DOCUMENTS

| | | | |
|---|---|---|---|
| GB | 709203 | | 5/1954 |
| GB | 737329 | | 9/1955 |
| GB | 778044 | | 7/1957 |
| GB | 807404 | | 1/1959 |
| JP | 2005-058229 | A | 3/2005 |
| JP | 2005-058232 | A | 3/2005 |
| JP | 2008-526192 | A | 7/2008 |
| WO | WO 03/009711 | A1 | 2/2003 |
| WO | WO 03/055338 | A2 | 7/2003 |
| WO | WO 2004/047572 | A1 | 6/2004 |
| WO | WO 2004/057986 | A2 | 7/2004 |
| WO | 2006/000918 | A2 | 1/2006 |
| WO | 2006-000918 | A2 | 1/2006 |
| WO | WO 2006/064371 | A1 | 6/2006 |
| WO | 2006-082476 | A2 | 10/2006 |
| WO | WO 2006/136196 | A1 | 12/2006 |
| WO | WO 2006/136197 | A1 | 12/2006 |
| WO | WO 2006/136198 | A1 | 12/2006 |
| WO | WO 2006/136199 | A1 | 12/2006 |
| WO | WO 2007/010407 | A3 | 1/2007 |
| WO | WO 2007/012981 | A2 | 2/2007 |
| WO | WO 2007/012981 | A3 | 2/2007 |
| WO | WO 2007/038053 | A1 | 4/2007 |
| WO | WO 2007/060543 | A2 | 5/2007 |
| WO | WO 2008/012329 | A2 | 1/2008 |

* cited by examiner

APPARATUS FOR ASSEMBLY OF MULTI-SEGMENT ROD-LIKE ARTICLES

BACKGROUND

Cigarettes and other smoking articles commonly include filter portions (universally known as filter segments) intended to remove some impurities and toxins from the cigarette smoke as it is inhaled. These filters may also add flavorings to the cigarette smoke as it is inhaled. Cigarette manufacturers may wish to include several different filter segments within a single cigarette filter in order to impart desired filtering and flavor characteristics to the cigarette. The several filter segments within a cigarette filter must usually be placed in a particular order and must lack gaps therebetween in order to function properly.

SUMMARY

An apparatus for assembly of multi-segment rod-like articles, particularly cigarette filters, including a filter segment intercalating unit, a filter rod assembly unit and a filter segment transfer unit coupled to the intercalating unit and the assembly unit, the intercalating unit further including at least one filter segment delivery unit and a filter rod transporting device. The multi-segment delivery unit including a hopper, a rotating drum having a plurality of transverse flutes and a plurality of circumferential slits defined in the surface thereof, and a cutting device disposed adjacent to said rotating drum, said cutting device having a plurality of blades received within said slits of the rotating drum in order to cut the filter rods into segments.

The transfer unit further includes a pulley assembly, a first wheel operatively engaged with said pulley assembly, a second wheel operatively engaged with said first wheel, and a third wheel operatively engaged with said second wheel, each of said first, second and third wheels having a plurality of fingers defined in the circumference thereof; and the assembly unit including a garniture, a filter rod gap sensor and a filter rod cutting device.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
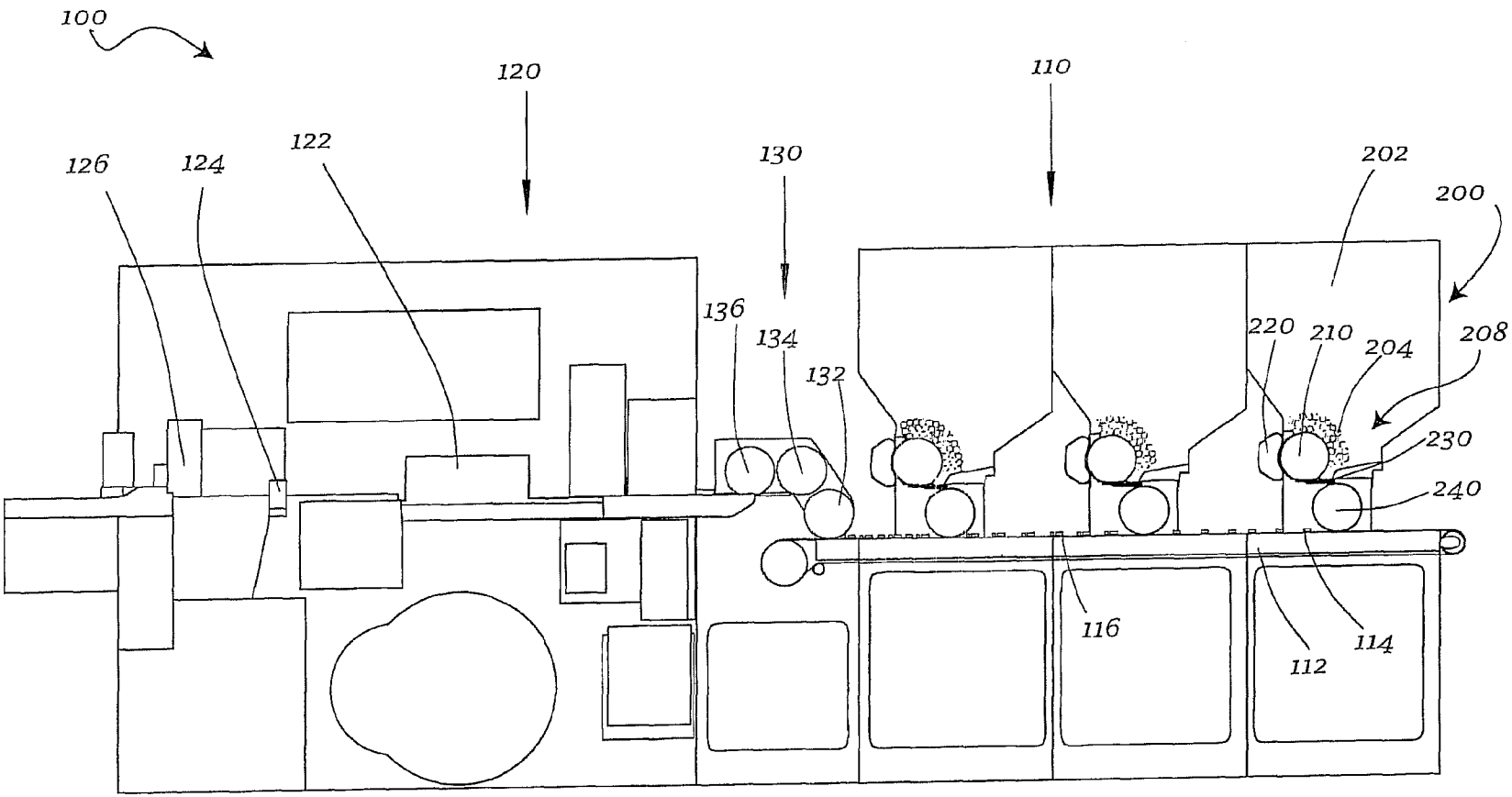
FIG. 1 is an exemplary diagram of an apparatus for assembly of multi-segment rod-like articles.

Turning to FIG. 1, there is provided an apparatus 100 for assembly of multi-segment rod-like objects, such as, for example, components of a composite cigarette filter. The apparatus may include an intercalating unit 110 and assembly unit 120. Intercalating unit 110 can be linked to assembly unit 120 by transfer unit 130. Intercalating unit 110 may include at least one rod supply unit 200 and conveyor 112. In one embodiment, intercalating unit 110 may include a plurality of independent rod supply units 200. Each rod supply unit 200 can include a hopper 202 and a rod delivery mechanism 208 comprising rotary drum 210, cutting device 220, transfer wheel 230 and delivery wheel 240. A quantity of base filter rods 204 may be stored hopper 202. In operation, base filter rods 204 may be collected by rotary drum 210, and subdivided into a predetermined number of filter rod segments 114 by cutting device 220. Filter rod segments 114 may then be placed on conveyor 112 via transfer wheel 230 and delivery wheel 240, as described in further detail below.

Each rod supply unit 200 may be coupled to intercalating unit 110 in a modular, or "plug-and-play" manner to facilitate coupling and decoupling of each rod supply unit 200 from intercalating unit 110 without extensive configuration. Such a manner of coupling may enable the user to quickly and simply adapt intercalating unit 110 based on the desired characteristics of the output composite cigarette filter. For example, hopper 202 of each rod supply unit 200 may contain base filter rods 204 of equal or varying size, structure, or other characteristics to those contained in any other rod supply unit 200, depending on the desired characteristics of the output composite filter. Each rod supply unit 200 may then deliver different or equal filter rod segments 114 to conveyor 112 such that each segment is placed on conveyor 112 in a desired order and with desired spacing in relation to other segments 114.

As a result, filter rod segments 114 may be grouped on conveyor 112 such that each group 116 contains the desired components of a composite cigarette filter arranged in the desired order. If a composite filter with a greater or fewer number of components is desired, one or more rod supply units 200 may be coupled or decoupled to intercalating unit 110 and provided with base filter rods 204 having the desired characteristics. Conveyor 112 may be driven by a servomotor or any other motive device known by one of ordinary skill in the art. The speed of conveyor 112 may be synchronized with the speed of rod delivery mechanism 208 of each rod supply unit 200.

Conveyor 112 may then carry filter segments 114 or groups of filter segments 116 to transfer unit 130. Transfer unit 130 may be configured to facilitate transfer of filter rod segments 114 or segment groups 116 to a garniture 122 of assembly unit 120. In one embodiment, conveyor 112 of intercalating unit 110 may be vertically offset relative to garniture 122 of assembly unit 120. Transfer unit 130 may be configured to facilitate transfer of filter rod segments 114 or segment groups 116 from conveyor 112 to a garniture 122 when conveyor 112 is vertically offset relative to garniture 122.

Figure 2A:
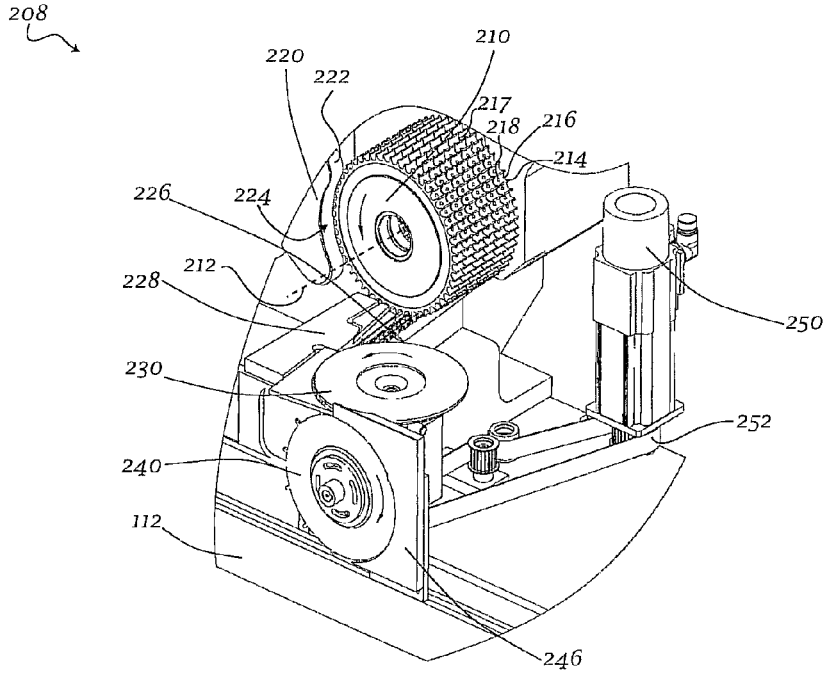
FIG. 2*a* is a view of an exemplary embodiment of a filter segment delivery mechanism of a filter rod supply unit.
Figure 2B:
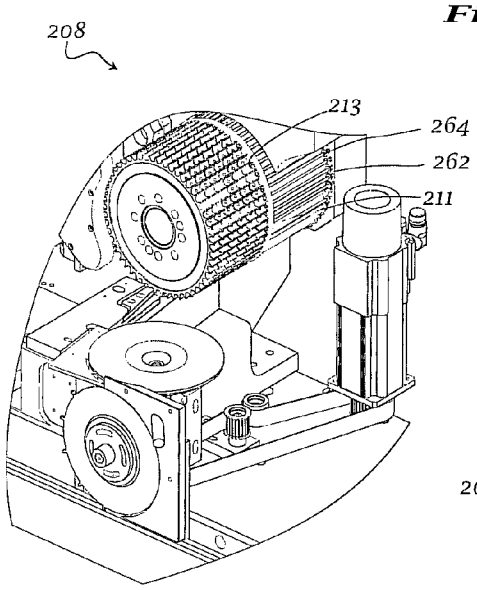
FIG. 2*b* is a view of another exemplary embodiment of a filter segment delivery mechanism of a filter rod supply unit.
Figure 2C:
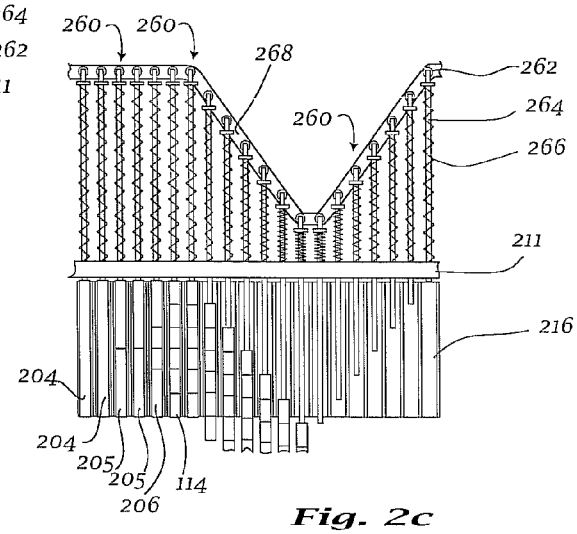
FIG. 2*c* is a diagram of a pushrod assembly for an exemplary embodiment of a filter rod supply unit.

Turning now to FIGS. 2*a*-2*c*, rod delivery mechanism 202 of a rod supply unit 200 may include a rotary drum 210, chain 226, guide plate 228, cutting device 220, transfer wheel 230, delivery wheel 240 and motor 250. Motor 250 may be a servomotor or any other motive device known to one of ordinary skill in the art. Motor 250 may drive rod delivery mechanism 208 via belt 252. Rotary drum 210 may rotate around an axis 212 and be disposed such that axis 212 is substantially horizontal. Rotary drum 210 may also have a width substantially similar to the width of a base filter rod 204, and may have a plurality of equidistant transverse grooves 214 defining a plurality of flutes 216 in its outer surface, such that grooves 214 and flutes 216 are substantially parallel to axis 212. Rotary drum 210 may also have equidistant circumferential slits 217, each slit 217 capable of receiving a cutting blade (not shown) within slit 217.

In one embodiment, the distance between two slits 217 may be substantially equal to the length of a filter rod segment 114. As a result, each flute 216 may be subdivided by slits 217 into a plurality of portions, wherein each portion may be substantially equal to the length of a filter rod segment 214. In one embodiment, aperture 218 may be provided in each portion of flute 216. Apertures 218 may be supplied with vacuum such that base filter rods 204 and filter rod segments 114 are maintained in contact with flutes 216 of rotary drum 210.

Cutting device 220 may be positioned adjacent to rotary drum 210 and may have side wall 222. Side wall 222 may have a substantially arcuate shape defining a cavity 224 such that a portion of the circumference of rotary drum 210 is received within cavity 224. Cutting device 220 may include a plurality of cutting blades (not shown). In one embodiment, the quantity of cutting blades (not shown) may be equal to the quantity of circumferential slits 217. The cutting blades (not shown) may protrude substantially into cavity 224 and may be received by slits 217 such that the edge of a cutting blade (not shown) may extend into rotary drum 210 beyond the surface of a flute 216, thereby facilitating the cutting of base filter rods 204 into half-segments 205 and intermediate segments 206, which may then be cut into filter rod segments 114.

Cutting blades (not shown) may be arranged within cutting device 220 depending on the desired size of filter segments 114. In one embodiment, the cutting blades may be arranged such that filter rods 204 are subdivided into half-segments 205 and intermediate segments 206 in successive cutting steps, as shown in FIG. 2*c*.

In one embodiment, as shown in FIG. 2*a*, rod delivery mechanism 202 may include a chain 226 and a guide plate 228. Chain 226 may be provided with pushing fingers (not shown) to facilitate transferring filter rod segments 114 from rotary drum 210 to transfer wheel 230. Guide plate 228 may facilitate keeping filter rod segments 114 in contact with chain 226 as they are transferred to transfer wheel 230.

In another embodiment, as shown in FIGS. 2*b* and 2*c*, rotary drum 210 may include a separation ring 211 and a plurality of pushrod assemblies 260 positioned substantially parallel to flutes 216. The quantity of pushrod assemblies 260 may be substantially equal to the quantity of flutes 216 such that each flute 216 has a corresponding pushrod assembly 260. Each pushrod assembly 260 may include a head 262, rod 264 and spring 266. Each rod 264 may have a length substantially equal to the length of a corresponding flute 216. Separation ring 211 may have a plurality of apertures 213 provided therein, such that each pushrod assembly 260 has a corresponding aperture 213. Each aperture 213 may have a diameter greater than the diameter of corresponding rod 264 and less than the diameter of corresponding spring 266, such that upon actuation of a pushrod assembly 260, rod 264 may pass through aperture 213 while spring 266 may be compressed against separation ring 211. As a result, as shown in FIG. 2*c*, upon actuation of a pushrod assembly 260, rod 264 can displace filter rod segments 114 within flute 216 and may then be returned to its original position via the decompression of spring 266. In one embodiment, the head 262 of each pushrod assembly 260 may be disposed within a groove 268 defined in a stationary cam (not shown). Groove 268 may be substantially curved such that groove 268 may approach separation ring 211. As a result, as drum 210 rotates, pushrod assemblies 260 may be actuated by means of pushrod heads 262 passing through groove 268.

Figure 4A:
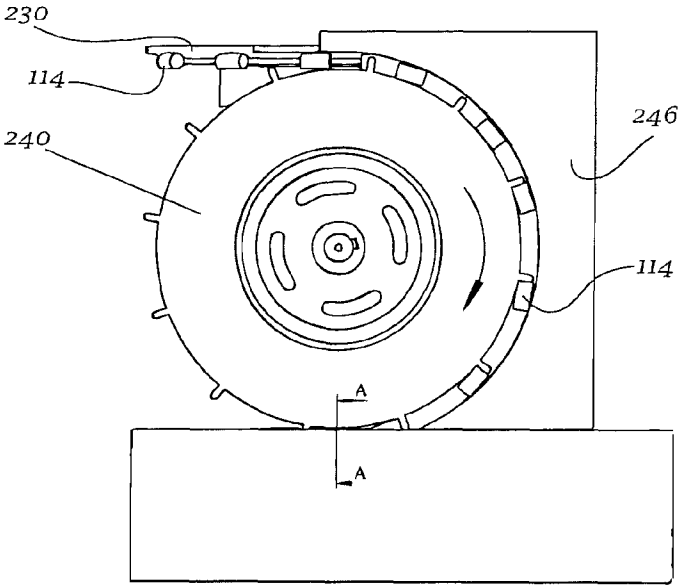
FIG. 4*a* is a view of a portion of an exemplary embodiment of a filter segment delivery mechanism and a conveyor belt.
Figure 4B:
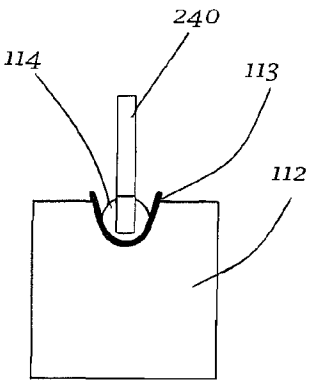
FIG. 4*b* is a cross section of a portion of an exemplary embodiment of a filter segment delivery mechanism and a conveyor belt along line A-A.
Figure 3:
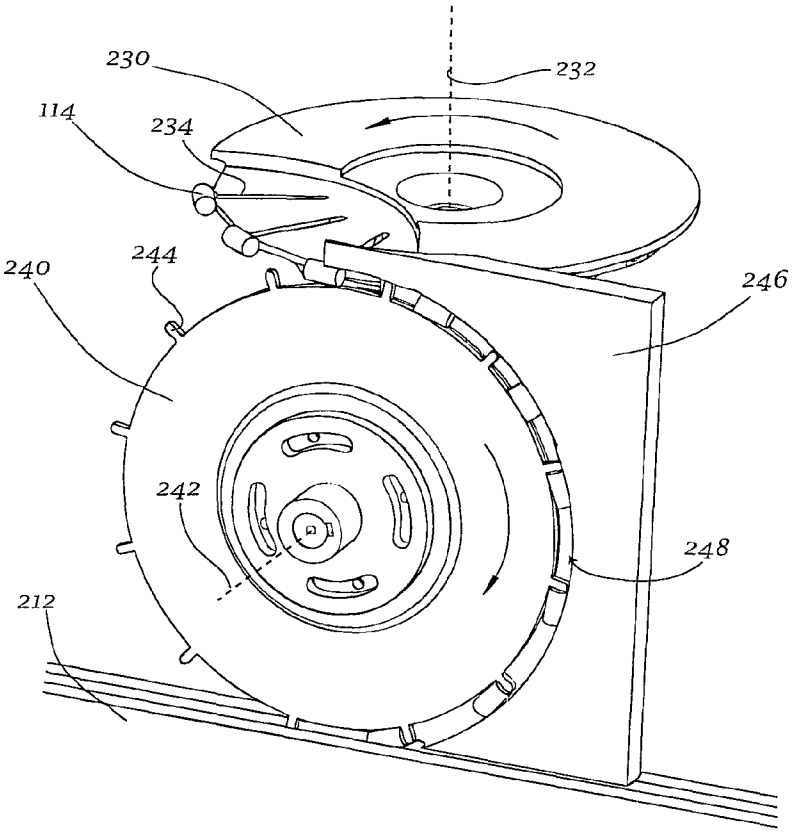
FIG. 3 is a view of a portion of an exemplary embodiment of a filter segment delivery mechanism.

Turning now to FIG. 3 and FIGS. 4*a*-4*b*, transfer wheel 230 may rotate around an axis 232 and may be disposed such that axis 232 is substantially vertical. Transfer wheel 230 may also have a plurality of internal radial grooves 234, each of which may terminate at an aperture (not shown) on the circumference of transfer wheel 230. Vacuum may be supplied to each radial groove 234 such that filter segments 114 are maintained in contact with the circumference of transfer wheel 230, thereby facilitating transfer of filter segments 114 between chain 226 and delivery wheel 240. Delivery wheel 240 may rotate around an axis 242 and can be disposed such that axis 242 is substantially horizontal.

Delivery wheel 240 may also be disposed to facilitate the transfer of filter segments 114 from transfer wheel 230 to delivery wheel 240. Delivery wheel 240 may include equally spaced fingers 244 positioned around the circumference of delivery wheel 240 and a guide plate 246 positioned adjacent to delivery wheel 240. Guide plate 246 may be positioned such that a channel 248 is defined between delivery wheel 240 and guide plate 246, with the width of guide channel 248 being substantially similar to the radius of filter segments 114. Fingers 244 can facilitate transfer of filter segments 114 from transfer wheel 230 to conveyor 112. Fingers 244 can also be positioned around the circumference of delivery wheel 240 to facilitate maintaining substantially equal spacing between any two successive filter segments 114 on conveyor 112. Conveyor 112 may have a groove 113 defined therein. Groove 113 may be substantially U-shaped and may have a radius substantially similar to the radius of filter segments 114 to facilitate transporting filter segments 114 on conveyor 112 such that spacing between segments 114 is not altered during transport.

In operation, base filter rods 204 may be placed in hopper 202 of a rod supply unit 200. Base filter rods 204 may then be delivered through the hopper to rotary drum 210, and picked up by rotary drum 210 such that each base filter rod 204 is carried within a single flute 216 of rotary drum 210. Vacuum supplied through apertures 218 provided within flute 216 may aid in maintaining contact between base filter rod 204 and the surface of flute 216. As drum 210 rotates, it can carry base filter rods 204 towards cutting device 220, where base filter rods 204 may be cut by a plurality of cutting blades (not shown) that are received within slits 217 of rotary drum 210. In one embodiment, base filter rods 204 may be cut into successively smaller portions by the cutting blades (not shown) of cutting device 220, such that each base filter rod 204 is cut into a plurality of segments 114.

For example, as shown in FIG. 2*c*, a base filter rod 204 can first be cut into two half-segments 205 in a first cutting step; in a second cutting step, each half-segment 205 may then be cut into an intermediate segment 206 and a filter rod segment 114. In a third cutting step, each intermediate segment 206 may then be cut into two filter rod segments 114. Following the cutting steps, filter rod segments 114 may be transferred to chain 226. In one embodiment, filter rod segments 114 may be ejected from flutes 216 by pushrod assemblies 260. Filter rod segments may then be picked up by transfer wheel 230 and maintained in contact with transfer wheel 230 by vacuum provided to apertures (not shown) on the circumference of transfer wheel 230. As filter rod segments 114 come in contact with the circumference of delivery wheel 240, they may enter guide channel 248 and be pushed through guide channel 248 by fingers 244 of delivery wheel 240.

At the end of guide channel 248, filter rod segments 114 may be deposited on conveyor 112, whereupon they may be conveyed towards a subsequent rod supply unit 200. Each subsequent rod supply unit 200 may deposit filter rod segments 114 on conveyor 112 such that each subsequent filter rod segment 114 is grouped with previous filter rod segments 114. In this manner, filter rod segment groups 116 are generated, wherein each filter rod segment group contains a set of filter rod segments 114 arranged in a desired order. Filter rod segment groups 116 are then conveyed by conveyor 112 towards transfer unit 130.

Figure 6A:
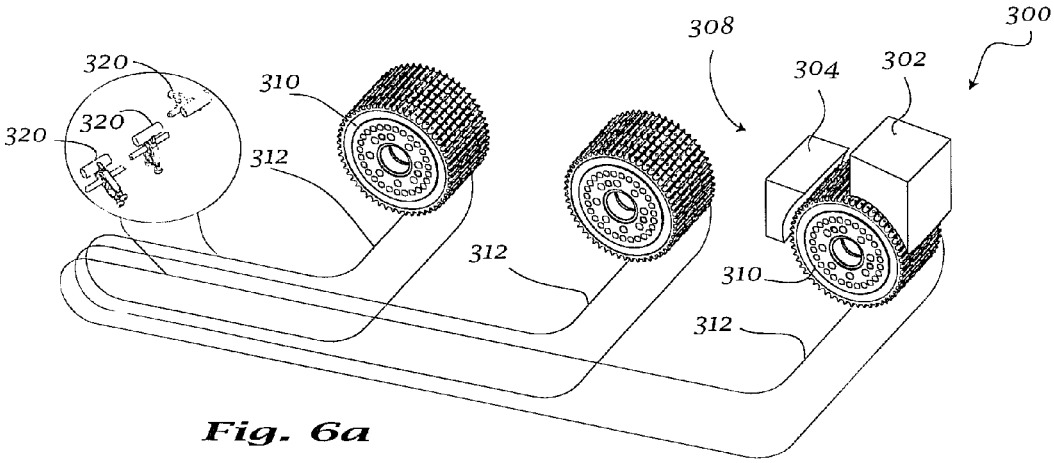
FIG. 6*a* is a view of an exemplary embodiment of a filter segment transport mechanism.
Figure 6B:
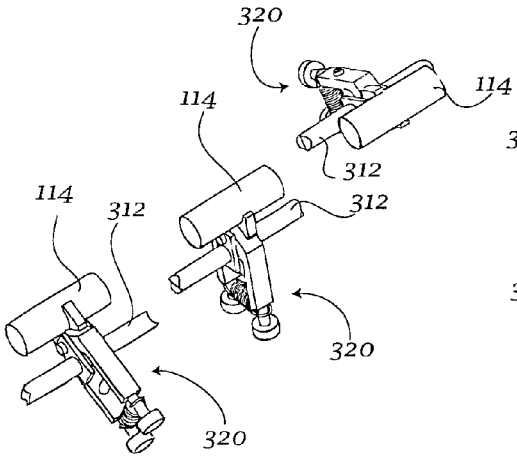
FIG. 6*b* is a view of a set of filter segment catchers.
Figure 6C:
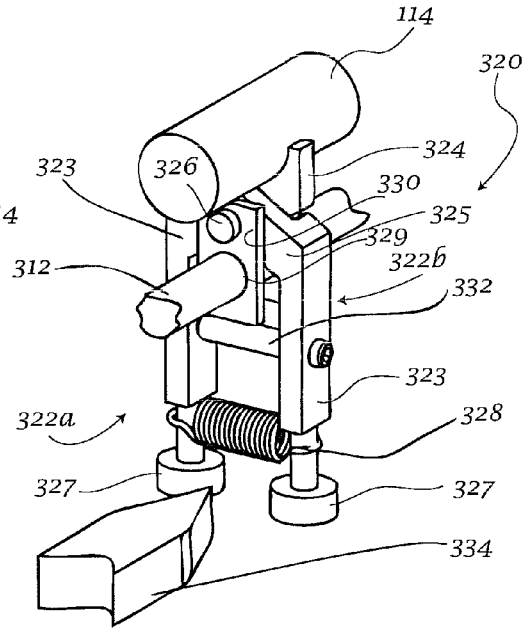
FIG. 6*c* is a detailed view of an exemplary embodiment of a filter segment catcher.
Figure 6E:
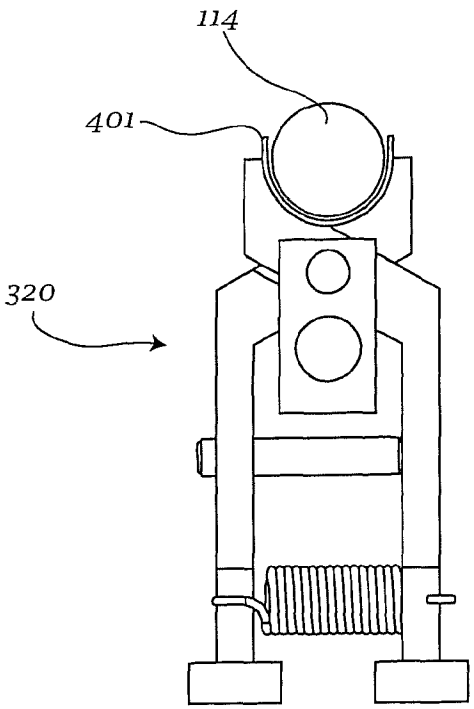
FIG. 6*e* is a view of an exemplary embodiment of a segment catcher.
Figure 6D:
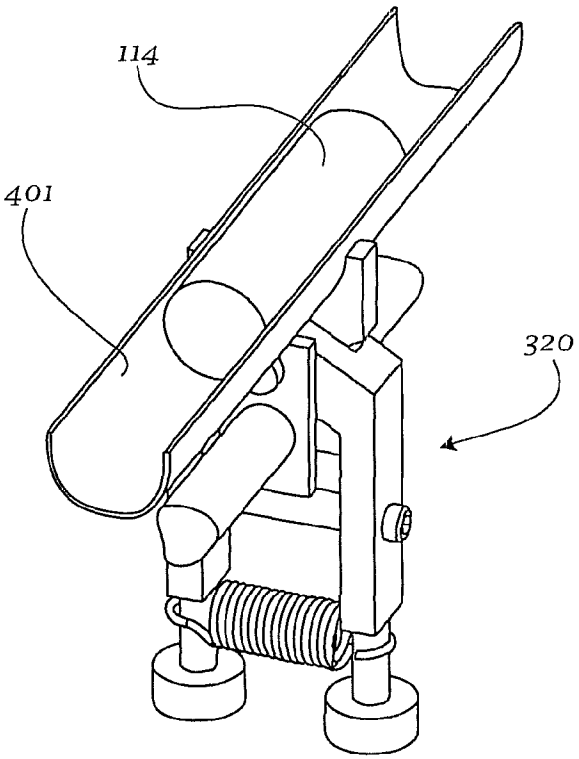
FIG. 6*d* is a view of an exemplary embodiment of a filter segment catcher.

In another embodiment, intercalating unit 110 may include at least one rod supply unit 300 and at least one flexible belt 312, as shown in FIG. 6*a*. Flexible belt 312 may have a plurality of segment catching devices 320 coupled thereto, as shown in FIGS. 6*b*-6*c*. Each rod supply unit 300 can include a hopper 302 and a rod delivery mechanism 308 comprising rotary drum 310, and cutting device 320. A quantity of base filter rods 204 may be stored hopper 302. In operation, base filter rods 204 may be collected by rotary drum 310, and subdivided into a predetermined number of filter rod segments 114 by cutting device 304. Filter rod segments 114 may then be received by segment catching devices 320 and conveyed via flexible belt 312 to transfer unit 130, as described in further detail below. In one embodiment, as shown in FIGS. 6*d*-6*e*, segments 114 may be deposited into a groove defined in the surface of a tape 401. Tape 401 with segment 114 disposed therein may then be received by segment catching devices 320 and conveyed via flexible belt 312 to transfer unit 130, as described in further detail below.

Each segment catching device 320 may include a pair of arms 322*a* and 322*b*. Each of arms 322*a* and 322*b* may have a first end 323, a second end 324 and a cross-member 325 positioned between first end 323 and second end 324. First end 323 and second end 324 of each arm may be positioned such that first end 323 of arm 322*a* is substantially coaxial with second end 324 of arm 322*b* and first end 323 of arm 322*b* is substantially coaxial with second end 324 of arm 322*a*. Cross-members 325 of each of arms 322*a* and 322*b* may be positioned transversely to each other, facilitating pivotally coupling arm 322*a* to arm 322*b* by pin 326. First end 323 of each of arms 322*a* and 322*b* may have a bottom portion 327 having a substantially cylindrical shape capable of engaging a cam 334 and may be springedly coupled by spring 328. Plate 330 may be coupled to pin 326 and may have aperture 329 defined therein. Aperture 329 may have a diameter substantially similar to the diameter of flexible belt 312 such that flexible belt 312 may be received within aperture 329 and be fixedly coupled to plate 330. Screw 328 may be threadably coupled to bottom end 323 of arm 322*b*.

A cam 334 may be received between cylindrical portions 327 of each of arms 322*a* and 322*b* and may spread apart cylindrical portions 327 such that segment catching device 320 is in an open configuration. At this point, a filter rod segment 114 may be received between the first ends 324 of each of arms 322*a* and 322*b*. As cam 334 is withdrawn, spring 328 may return 320 into a closed configuration and filter segment 114 may be frictionally coupled between first ends 324 of each of arms 322*a* and 322*b*. Screw 332 may be adjusted such that it extends toward and abuts bottom end 323 of arm 322*a*, thereby exerting a force to counteract spring 328. Further adjustment of screw 332 may facilitate changing the clamping force of first ends 324 on a filter rod segment 114. In one embodiment, segment catching device 320 may be adapted to receive filter rod segment 114. In another embodiment, segment catching device 320 may be adapted to receive tape 401 having filter rod segments 114 disposed therein.

In operation, a plurality of segment catching devices 320 may be positioned by flexible belt 312 under rotary drum 310 of a rod supply unit 300. Each segment catching device 320 may be positioned under rotary drum 310 such that each segment catching device 320 may receive a filter rod segment 114 from rotary drum 310. As each segment catching device 320 is positioned under rotary drum 310, cam 334 may place each segment catching device 320 into an open configuration. Filter segments 114 may then be released from rotary drum 310 and received by segment catching devices 320. In one embodiment, filter segments 114 may be deposited into a groove defined in the surface of a tape 401, and tape 401 with filter segments 114 disposed therein may be received by segment catching devices 320. Subsequently, cams 334 may be withdrawn and segment catching devices 320 returned to a closed configuration and carried by flexible belt 312 to transfer unit 130. Segments from each of a plurality of rod supply units 300 may be carried to transfer unit 130 in the above-described manner. Upon arrival at transfer unit 130, segment catching devices may be positioned such that filter segments 114 are aligned coaxially and positioned in a desired order. Segment catching devices may then be placed in an open configuration by cam 334 and filter segments 114 may then be transferred to transfer unit 130.

Figure 5:
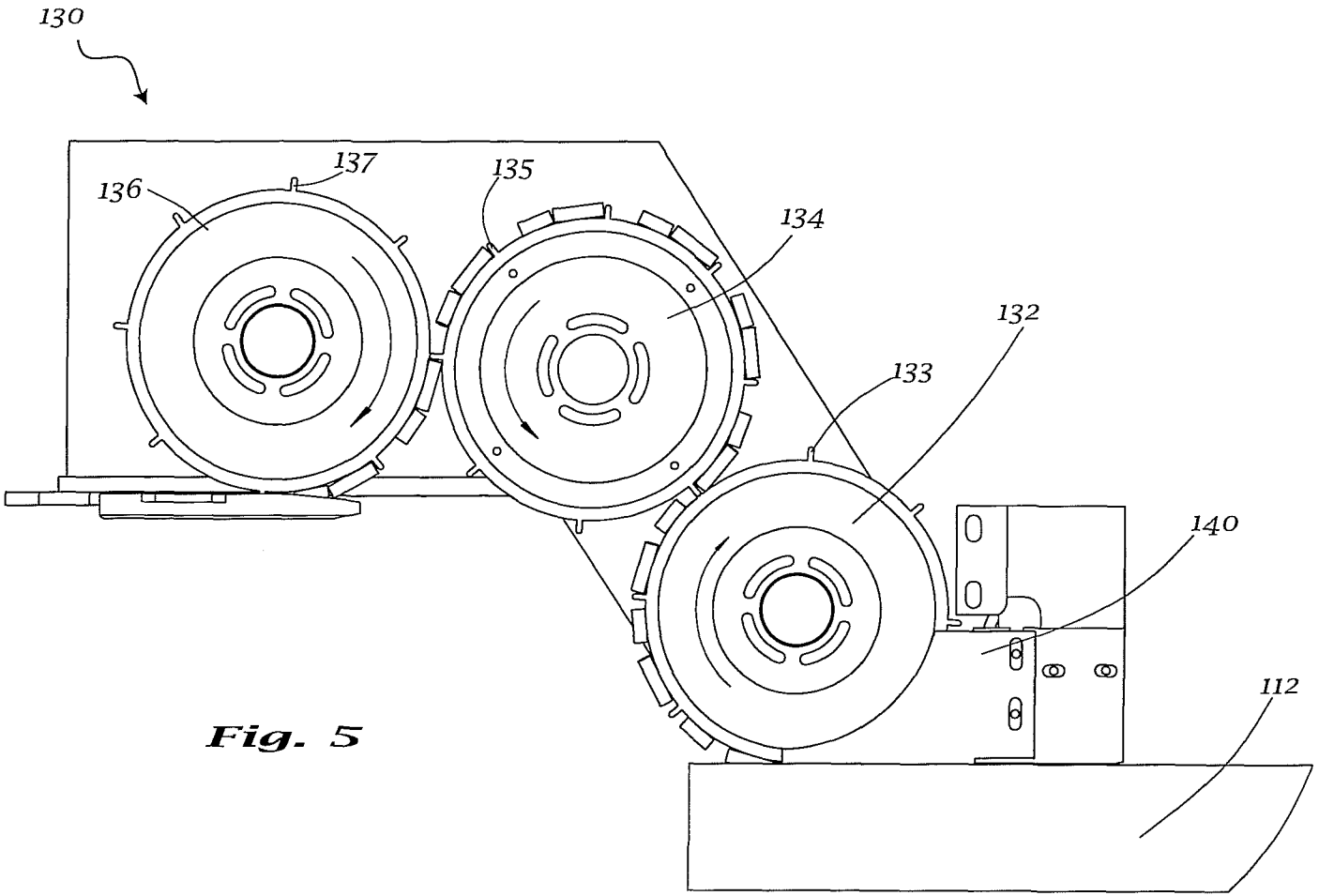
FIG. 5 is a view of an exemplary embodiment of a filter segment transfer unit.

Turning now to FIG. 5, transfer unit 130 may include a conveyor device 140, a first wheel 132, a second wheel 134 and a rotary wheel 136. Conveyor device 140 may facilitate transfer of filter rod segments 114 from conveyor 112 to first wheel 132. First wheel 132 may have equally spaced fingers 133 positioned around the circumference thereof. Fingers 133 may facilitate transfer of filter segments 114 and groups of filter segments 116 from first wheel 132 to second wheel 134. Similarly, second wheel 134 may have equally spaced fingers 135 positioned around the circumference thereof. Fingers 135 may facilitate transfer of filter segments 114 or groups of filter segments 116 from second wheel 134 to third wheel 136. Finally, third wheel 136 may have equally spaced fingers 137 positioned around the circumference thereof, and fingers 137 may facilitate transfer of filter segments 114 or groups of filter segments 116 from third wheel 136 to assembly unit 120. As filter segments 114 or groups of filter segments 116 are transferred from first wheel 132 to second wheel 134 and then to third wheel 136 the gaps between filter segments 114 or groups 116 of may be eliminated such that a continuous filter rod is deposited in assembly unit 120.

In one embodiment, first wheel 132 may be vertically offset relative to third wheel 136 to facilitate transfer of filter segments 114 or segment groups 116, when conveyor 112 and garniture 122 are vertically offset relative to each other. Consequently, first wheel 132 may be positioned at a height that facilitates the transfer of filter segments 114 or groups of filter segments 116 from conveyor 112 to first wheel 132, while third wheel 134 may be positioned at a height that facilitates transfer of filter segments 114 or groups of filter segments 116 from third wheel 136 to garniture 122. In one embodiment, second wheel 134 may be vertically aligned with third wheel 136. In another embodiment, second wheel 134 may be vertically aligned with first wheel 132. In another embodiment, second wheel 134 may be vertically offset from first wheel 132 and third wheel 136, thereby allowing transfer unit 130 to bridge varying vertical gaps between conveyor 112 and garniture 122.

In operation, filter rod segments 114 are carried by conveyor 112 to transfer unit 130. Upon entering conveyor device 140, filter rod segments may be engaged by conveyor device 140 and directed towards first wheel 132. As filter rod segments 114 approach first wheel 132, filter rod segments 114 may be engaged by fingers 133 of first wheel 132 such that a filter rod segment group 116 is disposed between any two fingers 133.

Filter rod segment groups 116 may then be transported by first wheel 132 towards second wheel 134 to a point where each group 116 may be substantially tangential to both first wheel 132 and second wheel 134. At this point, filter rod segments 114 may be engaged by fingers 135 of second wheel 134 such that a filter rod segment group 116 is disposed between any two fingers 135. Filter rod segment groups 116 may then be transported by second wheel 134 towards third wheel 136 to a point where each group 116 may be substantially tangential to both second wheel 134 and third wheel 136. At this point, filter rod segments 114 may be engaged by fingers 137 of third wheel 136 such that a filter rod segment group 116 is disposed between any two fingers 137. Filter rod segment groups 116 may then be transported by third wheel 136 to assembly unit 120.

Assembly unit 120 may include a garniture 122, a sensor 124 and a cutoff device 126. Groups of filter segments 116 may be deposited on garniture 122 via third wheel 134 of transfer unit 110. While on garniture 122, groups of filter segments 116 may be wrapped in a paper according to methods known in the art. Sensor 124 may then register gaps between filter segments 114 and groups of filter segments 116 to determine whether the gaps are within desired standards. Cutoff device 126 may then cut the continuous filter rod into individual filter rods, wherein each individual filter rod is composed of a group of filter segments 114 wrapped in a paper. Each individual rod may be cut to a specific desired length by cutoff device 126. Filter rods determined to not conform to desired standards by sensor 124 may then be ejected from the production line.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. An apparatus for assembly of multi-segment rod-like articles, particularly cigarette filters, comprising:

a filter segment intercalating unit, a filter assembly unit and a filter segment transfer unit coupled to the intercalating unit and the assembly unit, the intercalating unit further comprising a plurality of removably coupled filter rod delivery units and a filter segment transporting device, each filter rod delivery unit further comprising a hopper, a rotating drum having a plurality of transverse flutes and a plurality of circumferential slits defined in the surface thereof, a plurality of pushrods, each pushrod of said plurality of pushrods having a head, a rod, and a spring and having an associated flute of said plurality of flutes, a separation ring having a plurality of apertures such that each aperture corresponds to one of said plurality of pushrods, and a cutting device disposed adjacent to said rotating drum, said cutting device having a plurality of blades received within said slits of said rotating drum;

the transfer unit further comprising a conveyor device, a first wheel operatively engaged with said conveyor device, a second wheel operatively engaged with said first wheel, and a third wheel operatively engaged with said second wheel, each of said first, second and third wheels having a plurality of fingers defined on the circumference thereof, said first wheel and said third wheel are vertically offset relative to each other; and the assembly unit further comprising a garniture operatively engaged with said third wheel, a filter rod gap sensor and a filter rod cutting device.

2. The apparatus of claim 1, wherein each of said transverse flutes has a plurality of apertures defined in the surface thereof, said apertures being supplied with a vacuum.

3. The apparatus of claim 2, wherein the filter segment transporting device is a transport tape having a groove defined in the surface thereof.

4. The apparatus of claim 3, wherein the filter rod delivery unit further comprises:

a first wheel having a plurality of apertures defined in the circumference thereof, said apertures being supplied with a vacuum; and a second wheel operatively engaged with said first wheel and said filter segment transporting device, said second wheel having a plurality of fingers defined in the circumference thereof.

5. The apparatus of claim 2, wherein the filter segment transporting device is a flexible belt having a plurality of filter rod segment catching devices coupled thereto.

6. The apparatus of claim 5, wherein the filter rod segment catching devices are configured to receive a filter rod segment.

7. The apparatus of claim 5, wherein the filter rod segment catching devices are configured to receive a tape having a groove defined in the surface thereof.

8. The apparatus of claim 1, wherein said first wheel and said third wheel are vertically offset relative to each other.

9. The apparatus of claim 1, wherein said first wheel, said second wheel and said third wheel are vertically offset relative to each other.

10. The apparatus of claim 1, wherein said filter segment transporting device and said garniture are vertically offset relative to each other.

* * * * *